United States Patent [19]

Chang et al.

[11] 4,358,519

[45] Nov. 9, 1982

[54] TECHNIQUE OF INTRODUCING AN INTERFACE LAYER IN A THERMOPLASTIC PHOTOCONDUCTOR MEDIUM

[75] Inventors: Kuo H. Chang, Minneapolis; Tzuo-Chang Lee; Jacob W. Lin, both of Bloomington, all of Minn.

[73] Assignee: Honeywell Inc., Minneapolis, Minn.

[21] Appl. No.: 857,170

[22] Filed: Dec. 5, 1977

[51] Int. Cl.[3] ..... G03G 5/10; G03G 13/22; B41M 5/20

[52] U.S. Cl. ..... 430/2; 346/77 E; 346/151; 358/344; 365/47; 365/112; 427/54.1; 427/407.2; 430/67

[58] Field of Search ..... 427/144, 407 R, 54.1, 427/44, 407.2; 96/1.5 C, 1.5 R; 350/3.5, 2, 67; 346/77 E; 430/2, 67

[56] References Cited

U.S. PATENT DOCUMENTS

| | | | |
|---|---|---|---|
| 2,413,973 | 1/1947 | Howk et al. | 427/54 |
| 3,037,861 | 6/1962 | Hoegl et al. | 96/1.5 |
| 3,438,773 | 4/1969 | Hayashi et al. | 96/1.5 |
| 3,522,158 | 7/1970 | Garnett et al. | 427/44 |
| 3,861,914 | 1/1975 | Gange | 96/1.5 |
| 3,956,524 | 5/1976 | Weigl | 96/1.5 |
| 3,968,305 | 7/1976 | Oshima et al. | 427/54 |
| 4,012,253 | 3/1977 | Gange | 96/1.5 |
| 4,032,338 | 6/1977 | Gange | 96/1.5 |
| 4,131,462 | 12/1978 | Lee et al. | 96/1.5 R |

FOREIGN PATENT DOCUMENTS

| | | | |
|---|---|---|---|
| 2055861 | 5/1971 | France | 427/44 |
| 48-35497 | 10/1973 | Japan | 96/1.5 C |
| 1168641 | 10/1969 | United Kingdom | 427/44 |

*Primary Examiner*—Sadie L. Childs

*Attorney, Agent, or Firm*—Omund R. Dahle

[57] ABSTRACT

This invention pertains to an improved technique of introducing an added insulative layer between the thermoplastic layer and the photoconductive layer of the thermoplastic photoconductive holographic recording medium. The added layer (pure PVK) is electrically insulating at temperatures used for thermal development to prevent decaying charge contrast during hologram development.

10 Claims, 7 Drawing Figures

TECHNIQUE OF INTRODUCING AN INTERFACE LAYER IN A THERMOPLASTIC PHOTOCONDUCTOR MEDIUM

BACKGROUND OF THE INVENTION

Thermoplastic-photoconductor holographic recording medium has generally been in the form of several transparent layers over a transparent substrate. Thus, a substrate such as NESA glass or a flexible substrate such as Mylar is first coated thereon with an optically transparent electrically conductive layer, then a photoconductive layer, and finally a thermoplastic layer. Previous thermoplastic holographic recording media suffer the problem of decaying charge contrast at the interface of the photoconductive and the thermoplastic layer during hologram development, resulting in low diffraction efficiency or in worse cases no deformation at all.

The charge contrast created by the holographic light pattern through the action of the photoconductor resides at the interface of the thermoplastic layer and the photoconductive layer. During thermal development the charge contrast tends to diminish due to increased electrical conductivity of the thermoplastic layer. As a result, the driving force for the surface deformation is weakened, thereby the deformation is much less than it could be had the charge contrast maintained intact. There exists a large electrical potential difference between the bright fringe and the dark fringe at the interface and this potential difference has a tendency to diminish the charge contrast. At temperatures below the softening temperature of the thermoplastic, however, the electrical conductivity is not high enough to wipe out the charge contrast. For example, with a polyvinyl carbazole (PVK) layer as the photoconductive layer, the electron mobility is sufficiently low at temperatures below 100° C. to prevent charge smearing, but with the thermoplastic layer having a softening temperature of say 50° C., the charge contrast can be wiped out when the softening temperature is reached for a sufficiently long time.

In the copending application Ser. No. 658,324, filed Feb. 17, 1976, now U.S. Pat. No. 4,131,462 in the names of Tzuo-Chang Lee and Jacob W. Lin, entitled "New Device Configuration for Thermoplastic Recording" and assigned to the same assignee as the present invention, the above described limitations are improved upon by the introduction of a new layer between the thermoplastic layer and the photoconductive layer with the following properties: (a) It is non-photoconductive at the wavelength of the holographic recording but is photoconductive at a different wavelength. (b) It is electrically insulating at temperatures used for thermal development, that is, extremely low surface conductivity at the development temperature. The charge contrast created by the holographic exposure will, therefore, reside at the interface of this new layer and the photoconductive layer and during thermal development the charge contrast will remain intact. We can thus have a large driving force for deformation and achieve controllable and appreciable deformation.

After the thermal development, in the copending case, charges will reside across the new layer and they can be removed by using a wavelength to which the new layer is sensitive. An example described therein of fabricating such a device comprised a trinitrofluorenone (TNF) doped PVK layer first coated on, say, indium oxide on glass, and then a special solvent such as xylene was used to leach out an appropriate amount of TNF from the surface of the doped PVK. That procedure generated the new layer mentioned because pure PVK (PVK stripped of TNF) is photoconductive only at ultraviolet (UV) wavelengths and pure PVK is also electrically insulating at temperatures up to 180° C. Advantages of that copending invention are: (a) the hologram diffraction efficiency ($\eta$) can be higher, (b) the dynamic range of $\eta$ vs. heat energy is greatly increased while in prior art $\eta$ is critically dependent on heat energy, (c) thermoplastic with relatively high electrical conductivity can be used.

A limitation of the procedure shown in the copending application has arisen in that there is a certain lack of repeatability in forming the layer by leaching since the leached layer should be only a few tenths of a um thick. Also, the leached layer actually turns out to be something less than pure PVK throughout the layer as the leaching agent is not equally effective at a depth into the material as on the surface and an increasing gradient of TNF remains proceeding into the leached layer.

SUMMARY OF THE INVENTION

A specific procedure of creating a well-defined interfacial layer in a thermoplastic photoconductive medium by a monomer vinylcarbazole (VK) layer followed by UV polymerization to form polyvinylcarbazole (PVK) in situ.

DETAILED DESCRIPTION OF THE PREFERRED EMBODIMENTS

Figure 1:
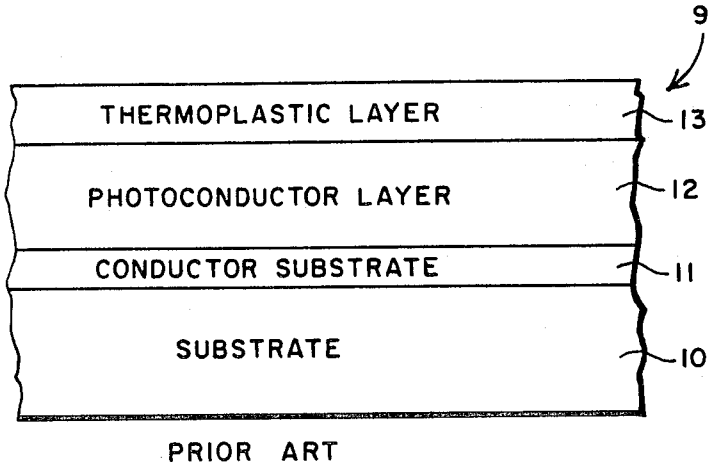
PRIOR ART FIG. 1
FIGS. 1 and 1*a* are sectional views of prior art thermoplastic-thermoconductive holographic recording medium construction.

The prior art thermoplastic photoconductive holographic recording medium referred to as 9 in FIG. 1, has a transparent conductive layer 10 coated over the substrate 11, usually InO is coated on glass substrates and metal thin film is coated on flexible Mylar tape. The conductive substrate is then coated with a photoconductive layer 12 and then a thermoplastic layer 13. Recording on thermoplastic-photoconductive holographic recording medium is described in such articles as "An Experimental Read-Write Holographic Memory," by Stewart, Mezrich, Cosentins, Nagle, Wendt, and Lahmar, RCA Review, 34 3 (March, 1973) and T. C. Lee, "Holographic Recording on Thermoplastic Films," Appl. Opt. 13, 888 (1974). The recording process includes the steps of electrically charging the medium, exposing the medium with the information to be stored, recharging and heating to allow the thermoplastic to deform.

Figure 1A:
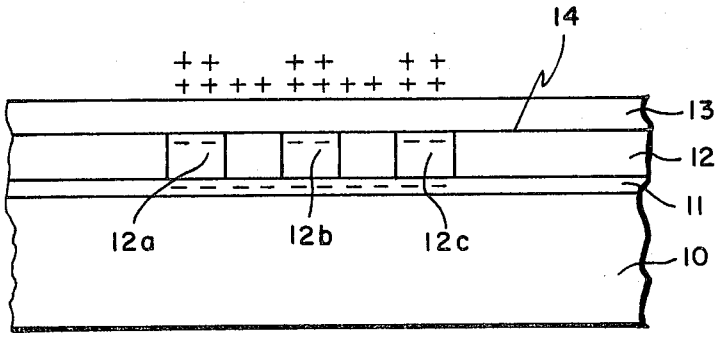
PRIOR ART FIG. 1a

In operation, i.e., in recording on the holographic recording medium, when the photoconductive layer 12 is selectively illuminated by an optical fringe pattern, the illuminated photoconductor sections 12*a*, 12*b*, and 12*c*, in FIG. 1*a*, become conductive allowing electrical charges to move adjacent the photoconductor-thermoplastic interface 14. During the subsequent hologram developing step, when the medium is heated to the softening temperature of the thermoplastic, a problem exists in that the charge contrast tends to decay or diminish due to increased electrical conductivity of the thermoplastic layer 13 at that temperature and the recording is not as successful as intended.

Figure 2:
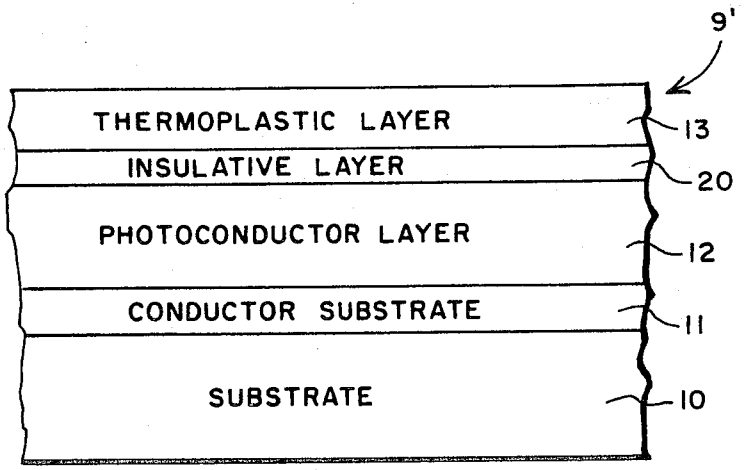
FIGS. 2 and 2*a* are sectional views of an improved thermoplastic-photoconductive holographic recording medium construction according to the invention.
Figure 2A:
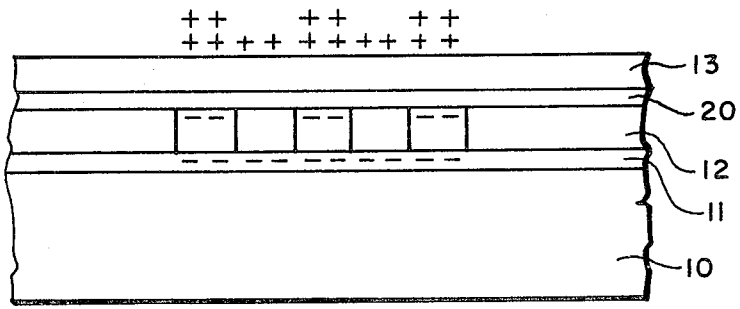

In the present invention shown in FIGS. 2 and 2*a*, the process of preparing the medium is changed from that of the prior art to introduce a new additional layer 20 between the photoconductive layer 12 and the thermoplastic layer 13 of the holographic recording medium 9'. The additional layer 20 is also photoconductive, but not at the wavelengths used for the holographic recording. In one successful example the photoconductive layer 12 coated onto the conductive layer is TNF doped PVK, and the new additional layer 20 is pure PVK. Pure PVK is electrically insulating at temperatures up to 180° C. PVK doped with TNF (layer 12) is photoconductive to UV and visible light. The surface layer 20 of pure PVK is not photoconductive at visible light wavelengths as is layer 12, the photoconductivity spectrum of layer 20 being different and occurring only in the ultraviolet wavelengths.

Referring to FIG. 2*a*, which shows representative charges during recording, it is seen that the charge contrast created by the holographic exposure resides at the interface of photoconductive layer 12 and the new insulative layer 20 and not at the thermoplastic interface. Thermal development at about 70° C. can now take place and the charge contrast remains intact.

We teach here a novel method to coat a pure and discrete PVK layer 20 on top of TNF-doped PVK layer by solutions coating without significantly damaging the prior PVK layer. This is accomplished by UV polymerization of vinyl carbazole (monomer). Since nonane dissolves vinyl carbazole but does not even wet TNF or PVK, it is chosen as the solvent for vinyl carbazole and Benzoin-n-butyl ether (UV initiator). The concentration of solution and the conditions of coating are so adjusted to render a resulting pure PVK layer of 0.1–0.2 μm. The novel method follows the steps below.

STEP 1 Coating a trinitrofluorenone (TNF) doped PVK (polyvinyl carbazole) layer on glass or tape substrate which has previously been coated with a conductive layer such as indium oxide. This TNF-doped PVK provides a photoconductive layer with a first wavelength range of response that is the recording wavelength.

STEP 2 Provide a monomer vinyl carbazole (VK) solution mixed with nonane.

STEP 3 Add an ultraviolet responsive initiator such as Benzoin-n-butyl ether to the VK solution for photopolymerization.

STEP 4 Coat the photoconductive TNF-doped PVK layer with a layer of the monomer VK solution.

STEP 5 Expose the monomer VK layer to ultraviolet radiation to cause it to polymerize to pure PVK in situ while the layer is still in liquid state. This step provides a layer between the photoconductive layer and the thermoplastic layer which is non-photoconductive at the recording wavelength but is photoconductive at a different wavelength (i.e., at UV wavelength); and it is electrically insulating at temperatures used for thermal development. During steps 2–5 the temperature of the solution is prefereably maintained at about 60° C. A deviation of a few degrees is permissable.

STEP 6 Coating with a layer of suitable thermoplastic. The thermoplastic may be selected from several known types such as copolymer, resin, homopolymer and terpolymer. After each layer was coated the devices were baked or heat treated in a vacuum oven at 90° C. for an hour.

EXPERIMENTAL RESULTS

A successful laboratory experiment using this novel method of introducing an added insulative layer between the photoconductive layer and the thermoplastic layer is described below.

MATERIALS

The n-vinyl carbazole (VK) used in this investigation and the free radical initiator, Benzoin-n-butyl ether (BBE) were commercially available. The necessary UV radiation band (centered at 360 nm) required to activate the free radical initiator was provided by a high pressure mercury arc lamp with a filter. The mercury lamp was activated by a universal lamp power supply.

MONOMER SOLUTION

VK was mixed with nonane. Nonane was selected in this investigation because: (1) it has a relatively high boiling point (168° C.) which provides a wider operating temperature range, (2) it is also the solvent used for the thermoplastic layer coating and one does not expect any chemical complications which could occur during and after the application of PVK layer. Although VK does not readily dissolve in nonane at room temperature, a homogeneous VK solution can be obtained by heating the mixture to a temperature near the melting point at VK (66° C.). The suitable coating temperature of the solution in this binary system depends on the molar ratio of the components. An appropriate amount of BBE was added to VK solutions as an initiator for photopolymerization of VK to PVK. The molecular weight distribution of polymerized PVK depends on the weight ratio of BBE used in the VK solutions.

UV POLYMERIZED PVK FILM AND THE THERMOPLASTIC-PHOTOCONDUCTIVE CONFIGURATION

A pure PVK thin film was obtained on top of the TNF-doped PVK layer by the UV polymerization of the VK solution. A quartz substrate first coated with a TNF-doped PVK film was dipped into the VK solution containing the BBE initiator and pulled out at a controlled rate. The solution temperature was about 60° C. The coated monomer film was then irradiated with UV radiation (peaking at 360 nm) for 20–30 seconds while the film was still warm and in its liquid state. The polymerized PVK layer is transparent while a polycrystalline monomer layers are opaque. The thermoplastic-photoconductive configuration was then completed by coating a thermoplastic thin film on top of the UV polymerized insulation layer.

From our experiments, it is clear that the thickness of UV polymerized PVK depends on the concentration, temperature and viscosity of the VK solution, and the pulling rate of the dip coating process. The concentration of the VK solution is expressed in terms of g % (i.e., gram of VK per 100 ml of nonane). Table 1 shows the measured viscosities of some VK solutions at various concentrations as function of temperature. The viscosity is expressed in centipoise × gm/ml. During this investigation, the most useful thickness has been 0.1–0.2 μm which is obtained by using 33.3 g %, pulling at a rate of 1.56 cm/minute at a temperature of about 60° C.

TABLE I

Viscosity (centipoise × g/ml) of VK Solutions at Various Temperatures

| Temperature °C. | centipoise × g/ml a* | b* | c* |
|---|---|---|---|
| 55 | .814 | .690 | .675 |
| 56 | — | — | .670 |
| 58 | .768 | .675 | — |
| 60 | — | — | .659 |
| 61 | .737 | .652 | — |
| 63 | — | — | .625 |
| 64 | .728 | .628 | — |
| 65 | — | — | .609 |
| 67 | .720 | .618 | — |

*a, b, c are the concentrations of vinylcarbazole in nonane (solvent) and a, b, c are 50g %, 40g % and 33.3g % respectively.

We have also analyzed the degree of UV polymerization by means of gel permeation chromatography (GPC). Numerous samples were obtained of the UV polymerization product of 33.3 g % VK solutions containing 0.5% of BBE initiator. A major component with a number average molecular weight peaking near $2\times10^3$ g/mole was obtained in most of the cases. Other minor components that have peaks at $4\times10^5$, $2.8\times10^5$, $1.4\times10^5$, $8\times10^3$ and $4\times10^3$ were also observed and the sizes of these peaks varies from sample to sample. We attribute this variation to the fact that, under the present experimental facility, the thin VK film can only be maintained in a liquid state for very short periods of time, and the polymerization processes tended to be terminated at a fairly early stage.

CHARACTERIZATION OF THE NOVEL CONFIGURATION

In consideration of the improved charge contrast retention of the new configuration, all samples for this investigation were coated with a 0.8 μm thermoplastic layer and a 1.8 μm TNF doped PVK layer. A vinyl carbazole layer was coated on top of the TNF doped PVK layer and photopolymerized to make a pure PVK layer of about 0.15 μm in thickness. Then a layer of the thermoplastic was spin coated. All samples were charged to ~V/μm, exposed with two converging laser beams with a net power of $2.8\times10^2$ $\mu Jcm^{-2}$ at a special frequency of 831 lines $mm^{-1}$. Then they were developed with the optimum heating energy.

LATENCY AND DIFFRACTION EFFICIENCY

Latency is the time between exposure and heat development. The experimental procedure includes: (1) turn on the Corona to charge the sample, (2) expose to an optical interference pattern, (3) turn off the Corona to stop charging and wait for a selected duration, and (4) finally develop the sample by heat.

Figure 3:
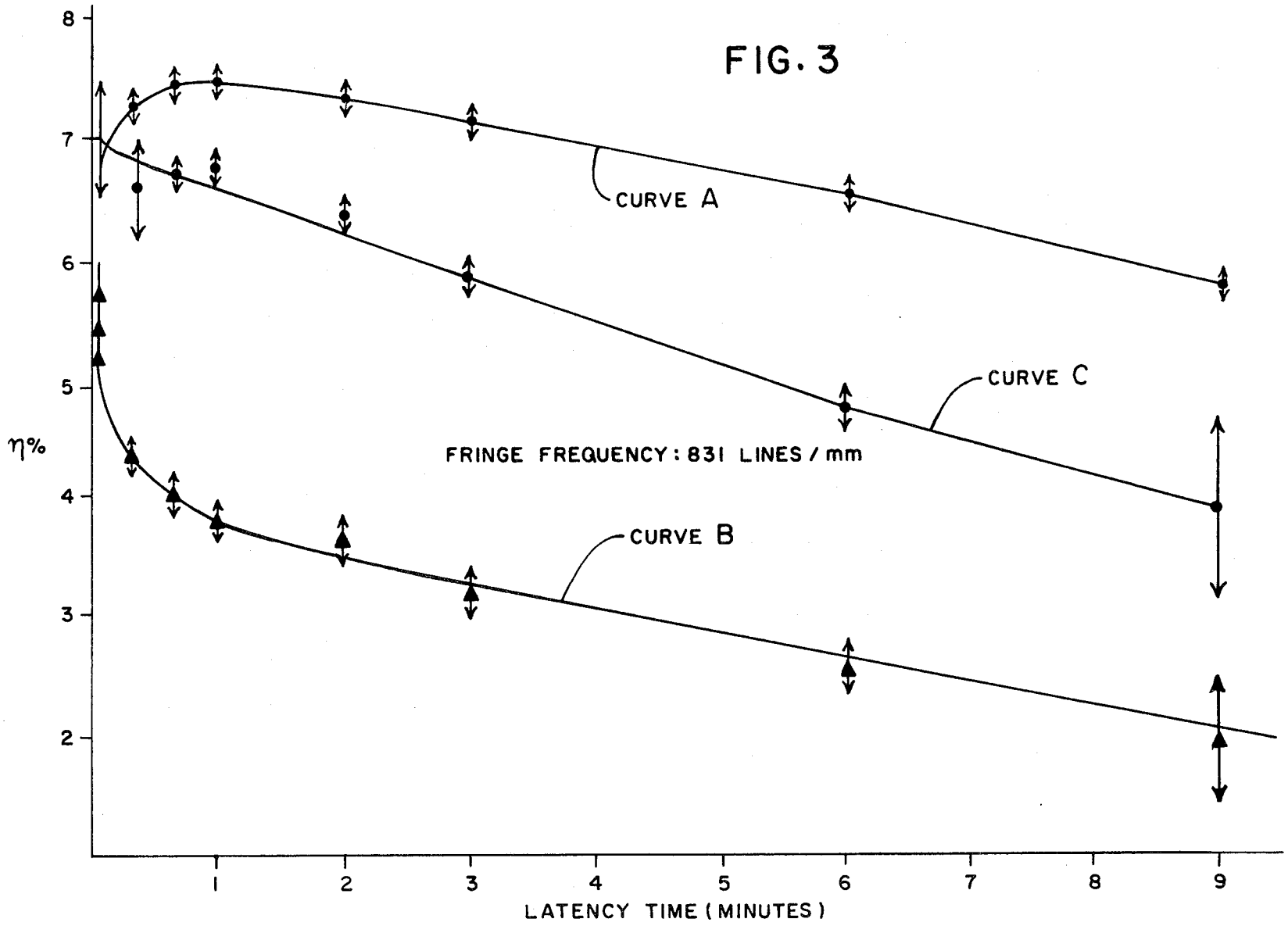
FIG. 3 is a plot of diffraction efficiency versus latency time in minutes for the recording medium configuration of this invention and of an earlier configuration.

We have observed an increased latency by adding the interfacial layer. FIG. 3 shows the diffraction efficiency as a function of latency for a sample prepared according to the invention, Curve A, and the sample prepared according to prior art configuration, Curve B. The result for the co-pending application is shown in Curve C. The diffraction efficiency of our novel sample increases initially with the latency time, reaches to a peak at a latency of about one minute, and then gradually decreases to about 80% of the peak value nine minutes later. We ascribe the initial rise to the establishment of a more complete electron charge contrast at the interface after the slowly moving electrons in the pure PVK layer are completely stopped. The gradual fall is due to the dark decay of the average charge through charge injection at the TNF-doped PVK indium oxide interface. For the configuration of the co-pending application, the diffraction efficiency decreases sharply at first due to the fast charge contrast decay and then gradually tapers off. Thus, the novel configuration is attractive for application requiring long latency.

Figure 4:
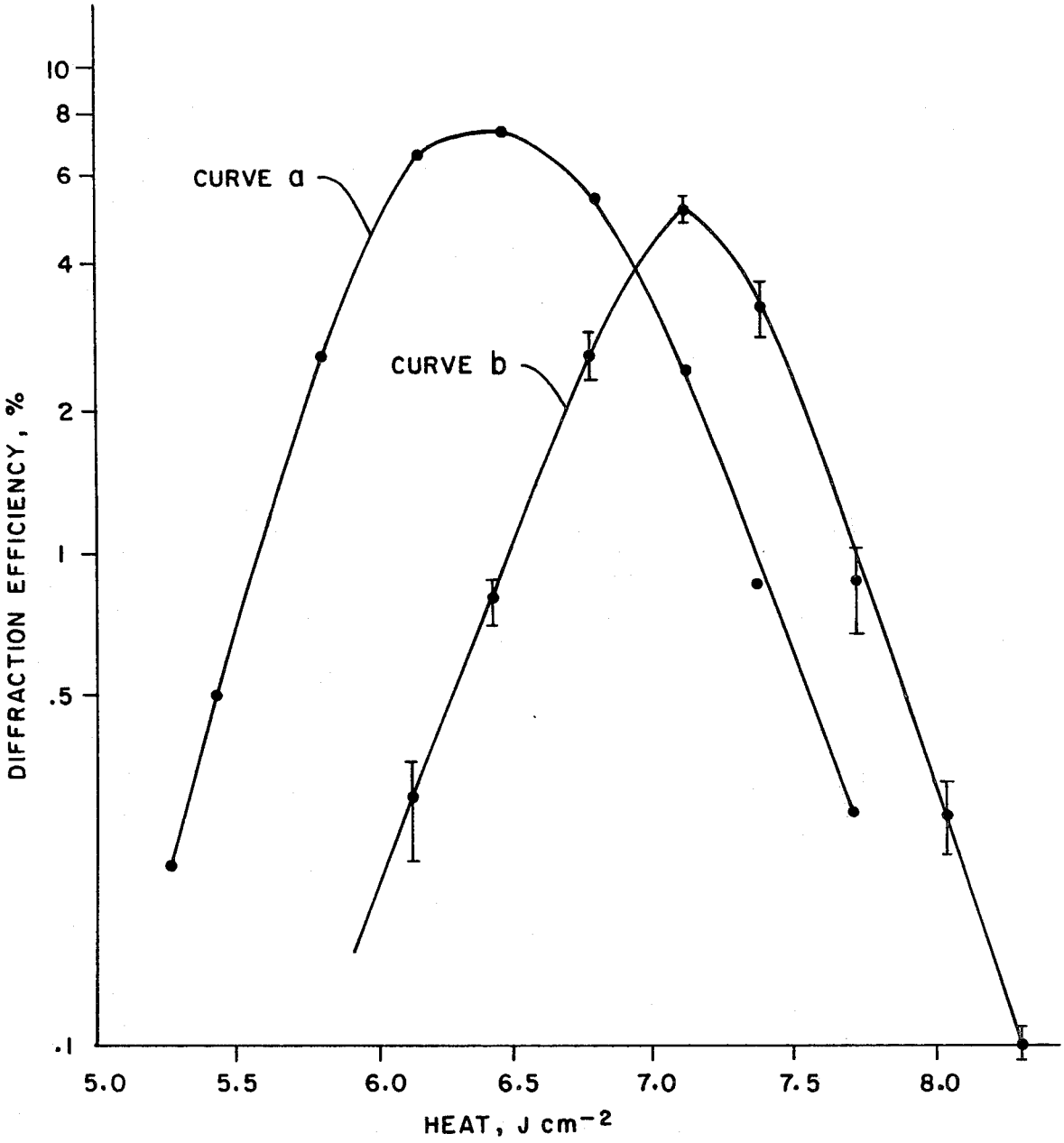
FIG. 4 is a plot of diffraction efficiency versus heat for the recording medium configuration of this invention under two operating conditions.
Figure 5:
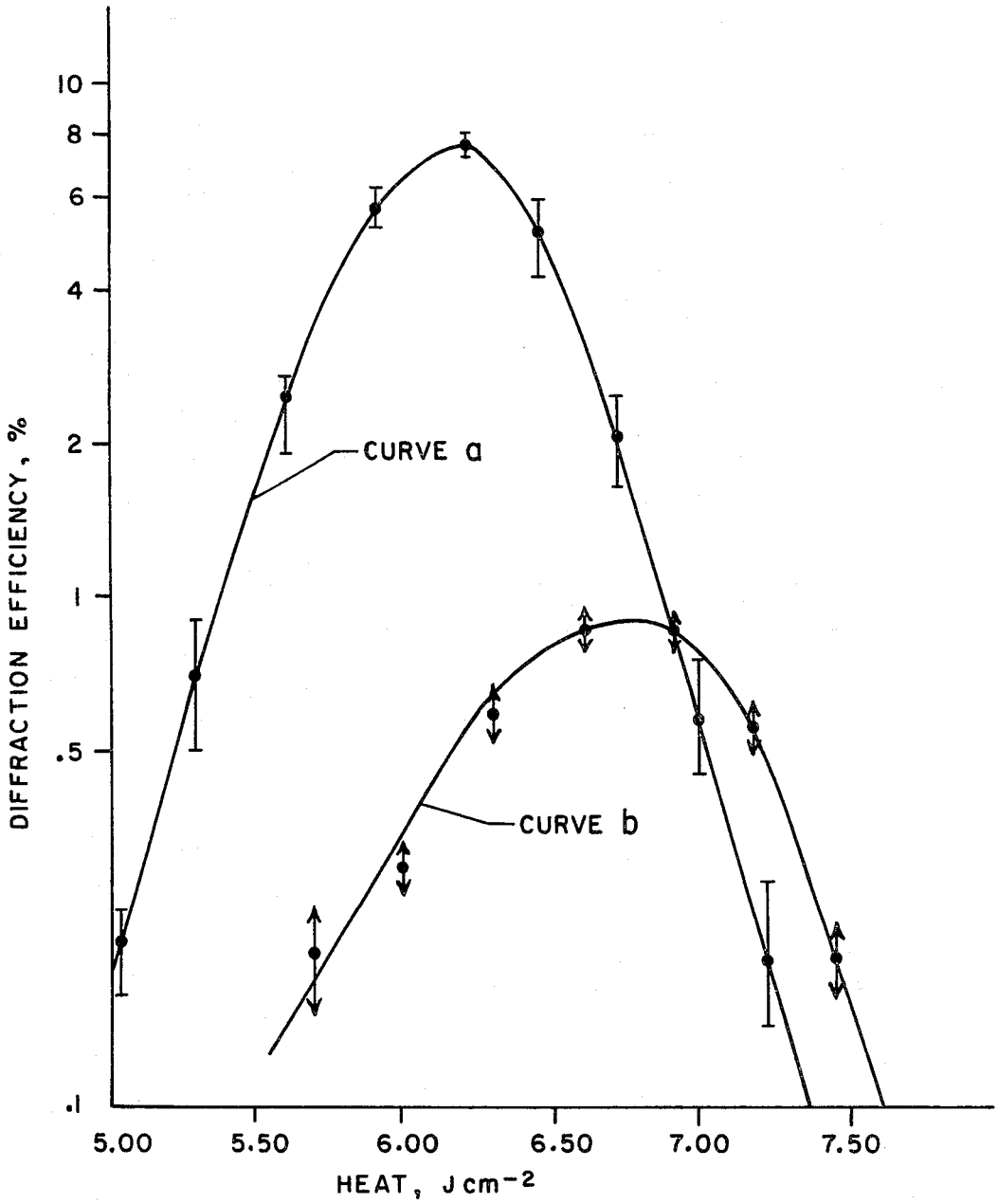
FIG. 5 is a plot similar to FIG. 4 for an earlier recording medium configuration.

In an effort to better characterizing the novel configuration, we have also performed an experiment without post charging. The procedure of this experiment is: (1) turn on the Corona to charge the sample for 10 seconds, (2) turn off the Corona to stop charging, (3) wait for three seconds and then expose to interference pattern, and (4) finally develop the sample by heat. A diffraction efficiency versus development heat for this experimental procedure, together with that obtained using the regular development procedure (pre-charge, expose, post-charge, heat development), are shown in FIG. 4 Curve a and curve b respectively. It shows that an omission of post-charge results in a reduction in diffraction efficiency of about 30% (comparing at the optimum diffraction efficiency). A similar experiment was carried out using the prior art configuration for comparison. Curve a and Curve b of FIG. 5 are the plots of diffraction efficiency versus development heat for the procedure with post-charge and that without post-charge respectively. It is clearly seen that the reduction of diffraction efficiency due to omission of post-charge step is as large as 88% for the prior art configuration.

In view of the ability to keep the charge contrast intact, one should expect to obtain much higher diffraction efficiency in the novel configuration of this invention than in the prior art configuration. However, we observe that the diffraction efficiency for the novel configuration shows only slightly better result. A tighter control on the sample preparation procedure and optimizing the parameter of preparation are required to consistently obtain a device with high performance.

FROST NOISE

A source of noise unique to the thermoplastic film is from "frost." Frost is a narrow band random deformation caused by the presence of a uniform surface charge. In the configurations of the copending application, frost is much stronger in the area outside the hologram than in the area occupied by the hologram. In the configuration of this invention, the frost outside the hologram area practically disappears, while the frost inside the hologram varies from being weak to nil at a hologram diffraction efficiency as high as 8%. We cannot yet explain this phenomenon.

With the practical elimination of frost noise, one can expect that the readouts will have high signal-to-noise ratio, which is essential for the application of the thermoplastic medium to holographic recording and optical data processing.

CONCLUSION

We have successfully prepared a pure PVK layer on top of the TNF doped PVK layer. We have observed improved performance of this novel configuration over both the configuration of the co-pending application and the prior art configuration in the areas of diffraction efficiency, latency and frost noise. With the desirable characteristics of the novel configuration, the new device will enhance the applications of thermoplastic holographic recording.

The embodiments of the invention in which an exclusive property or right is claimed are defined as follows:

1. A process for providing an insulative layer between a photoconductive layer and a thermoplastic layer of an improved alterable holographic thermoplastic-photoconductive recording medium comprising the steps of:

a - providing a substrate coated with a conductive layer which is overcoated with a photoconductive layer of trinitrofluorenone (TNF) doped polyvinyl carbazole (PVK);

b - providing a monomer vinyl carbazole (VK) solution;

c - adding an ultraviolet responsive initiator to the monomer VK solution for photopolymerization;

d - coating the photoconductive TNF-doped PVK layer with a layer of the monomer VK solution;

e - exposing the monomer VK layer to ultraviolet radiation causing the layer to polymerize to pure PVK while the layer is in liquid state; and, f - overcoating the pure PVK with a layer of a suitable thermoplastic material.

2. The process according to claim 1 wherein the monomer vinyl carbazole solution is mixed with nonane.

3. The process according to claim 1 wherein the ultraviolet responsive initiator is Benzoin-n-butyl ether.

4. The process according to claim 1 wherein the monomer vinyl carbazole solution is mixed with nonane and the ultraviolet responsive initiator is Benzoin-n-butyl ether.

5. The process according to claim 1 and further comprising the step of:

maintaining the temperature of the solution about 60° C. for steps b, c, d, and e.

6. In an alterable holographic thermoplastic-photoconductive recording medium of the type in which a substrate is coated successively with a conductive layer, a photoconductive layer and a thermoplastic layer, a novel process for introducing an additional electrically insulative layer on the photoconductive layer before the thermoplastic layer is coated thereon, this additional insulative layer being photoconductive but at a wavelength different from that used in recording, comprising the steps of:

a - providing a monomer vinyl carbazole (VK) solution;

b - adding an ultraviolet responsive initiator to the monomer VK solution for photopolymerization;

c - coating the photoconductive layer with a layer of the monomer VK solution; and d - exposing the monomer VK layer to ultraviolet radiation causing the layer to polymerize to pure polyvinyl carbazole while the layer is in liquid state.

7. The process according to claim 6 wherein the monomer vinyl carbazole (VK) solution is mixed with nonane.

8. The process according to claim 6 wherein the ultraviolet responsive initiator is Benzoin-n-butyl ether.

9. The process according to claim 6 wherein the monomer vinyl carbazole solution is mixed with nonane and the ultraviolet responsive initiator is Benzoin-n-butyl ether.

10. The process according to claim 6 and further comprising the step of:

maintaining the temperature of the solution about 60° C. for steps a, b, c, and d.

* * * * *